US010246643B2

(12) United States Patent
Gephart et al.

(10) Patent No.: US 10,246,643 B2
(45) Date of Patent: Apr. 2, 2019

(54) PROCESS AND APPARATUS FOR PRODUCING HYDROCARBON FUEL FROM WASTE PLASTIC

(71) Applicant: Virens Energy, LLC, Denver, CO (US)

(72) Inventors: Stephen B. Gephart, Madison, NJ (US); John C. Hill, Denver, NJ (US)

(73) Assignee: Virens Energy, LLC., Denver, CO (US)

( * ) Notice: Subject to any disclaimer, the term of this patent is extended or adjusted under 35 U.S.C. 154(b) by 96 days.

(21) Appl. No.: 15/623,689

(22) Filed: Jun. 15, 2017

(65) Prior Publication Data

US 2017/0283707 A1 Oct. 5, 2017

Related U.S. Application Data

(62) Division of application No. 14/487,023, filed on Sep. 15, 2014, now Pat. No. 9,725,655.

(51) Int. Cl.

| | |
|---|---|
| ***C10G 1/10*** | (2006.01) |
| ***C10G 1/02*** | (2006.01) |
| ***C10G 19/00*** | (2006.01) |

(52) U.S. Cl.

CPC ..... *C10G 1/10* (2013.01); *C10G 1/02* (2013.01); *C10G 19/00* (2013.01)

(58) Field of Classification Search

CPC combination set(s) only.

See application file for complete search history.

(56) References Cited

U.S. PATENT DOCUMENTS

| | | | | |
|---|---|---|---|---|
| 2,419,245 A * | 4/1947 | Arveson | B01J 8/26 34/588 |
| 2,462,891 A * | 3/1949 | Noll | B01J 8/32 208/127 |
| 2,984,602 A * | 5/1961 | Nevens | C10G 1/02 201/12 |
| 3,531,095 A | 9/1970 | Frans | |

(Continued)

FOREIGN PATENT DOCUMENTS

| | | |
|---|---|---|
| CA | 2202941 | 4/1997 |
| EP | 0140846 | 5/1985 |

(Continued)

*Primary Examiner* — Kaity V Chandler

(74) *Attorney, Agent, or Firm* — Karin A. Bartels

(57) ABSTRACT

A process and apparatus for producing hydrocarbon oil from the thermal decomposition of waste plastics in a continuous process which comprises melting of a waste plastic feedstock into an auger assisted melt reactor to remove chlorine and organics contained in the waste plastic, and transferring the melted waste plastic into an heated screw pyrolysis reactor which includes a transitional metal heat transfer medium. The hydrocarbon gas from the pyrolysis reactor is fed into a vessel containing metal trays for a second decomposition which is connected with an alkali treatment 2-step process gas reactor to remove acidic gases, and any inorganic solids. The hydrocarbon gases are separated by three separate condensers. The hydrocarbon fraction of the first condenser is recycled back into the pyrolysis reaction for further thermal treatment, and the hydrocarbon fractions are collected in the remaining condensers.

12 Claims, 2 Drawing Sheets

(56) References Cited

U.S. PATENT DOCUMENTS 4,851,084 A 7/1989 Hauser et al.
5,209,287 A * 5/1993 Johnson ..... B01J 8/1836 165/104.16
5,916,529 A * 6/1999 Scheuerman ..... B01J 8/003 208/148
6,133,491 A 10/2000 Xing
6,172,271 B1 1/2001 Horizoe et al.
6,270,630 B1 8/2001 Xing
6,346,220 B1 2/2002 Kosugi et al.
6,387,221 B1 * 5/2002 Schoenhard ..... C10G 1/02 201/25
6,534,689 B1 3/2003 Stankevich
6,774,271 B2 8/2004 Jiang
7,932,424 B2 4/2011 Fujimoto
8,961,743 B2 * 2/2015 Freel ..... C10B 49/22 202/99
9,725,655 B2 * 8/2017 Gephart ..... C10G 1/10
2002/0159929 A1 * 10/2002 Kaneko ..... C07C 29/152 422/140
2004/0079262 A1 * 4/2004 Hornung ..... C10B 7/10 110/246
2009/0218209 A1 * 9/2009 Poulleau ..... B09B 3/00 201/10
2010/0163395 A1 * 7/2010 Henrich ..... C10B 49/16 201/2.5
2011/0067991 A1 * 3/2011 Hornung ..... C10B 7/10 201/32
2012/0063965 A1 3/2012 Coates et al.

FOREIGN PATENT DOCUMENTS

EP 2230290 A2 9/2010
WO WO 91/00899 1/1991
WO WO03104354 A1 12/2003
WO WO 2012/172527 A2 12/2012

* cited by examiner

PROCESS AND APPARATUS FOR PRODUCING HYDROCARBON FUEL FROM WASTE PLASTIC

The present application is a divisional application of the U.S. application Ser. No. 14/487,023 and claims the benefit of U.S. application Ser. No. 14/487,023 filed on 2014 Sep. 15.

FIELD OF INVENTION

The present invention is directed to a process and apparatus for producing liquid fuel from residential and industrial waste plastic, and in particular, to a process and apparatus for producing continuously high quality grade liquid hydrocarbon fuel from residential and industrial waste plastic by thermal and catalytic decomposition in an indirectly heated screw reactor.

BACKGROUND OF THE INVENTION

Waste plastic from municipal and industrial sources s continuously increasing. In the U.S., the amount of plastic waste produced in 2010 was 31 million tons, an increase of 25% in ten years. Only 8 percent of the total plastic waste generated in 2010 was recovered for recycling. Waste plastic represents a considerable part of municipal wastes. Over 78 wt % of the total municipal plastic waste comprises thermoplastics with the remainder being thermosets. Thermoplastics are composed of polyolefins which include polyethylene (PE), polypropylene (PP), polyethylene terephthalate (PET), polystyrene (PS) and polyvinyl chloride (PVC). These polyolefins can be recycled. A large market exists for municipal and industrial thermoplastic to recover hydrocarbon fuels from these polymers. In particular, PE and in particular high density polyethylene (HDPE), low density polyethylene (LDPE) and PP play an increasing role in energy recovery systems because of their high energy value. These waste plastics are attractive materials for the conversion into liquid fuel and recycled feedstock because of their high recovery conversion rate.

There is a steadily increasing demand for technologies which are capable of converting waste plastic materials efficiently into useful products, and in particular converting non-recycled plastics into liquid fuel using efficient and economical processes based on thermal decomposition.

The art is replete with examples of processes and apparatus for the thermal decomposition of waste plastics.

Many methods disclose thermal cracking of waste plastic feedstock, the majority of these processes use a combination of high temperature and catalysts. U.S. Pat. No. 6,270,630 to Li Xing discloses a 2-step thermal cracking process whereby a first cracking reaction is performed in a rotary vessel at 400-500° C. and a second catalytic cracking step at 600-800° C. using a zeolite catalyst. The 2-step cracking process requires high capital investment and high operating cost. Another disadvantage is the use of a catalyst and the inherent catalyst deactivation over time by coke formed during the high temperature of the second cracking reaction. Furthermore, the cracking reaction is prone to coke formation which reduces the hydrocarbon formation rendering the 2-step cracking process less efficient for making high grade hydrocarbon oil from waste plastic. A common problem with thermal decomposition of waste plastic is the coke formation in the reaction vessel which reduces the heat conductivity. U.S. Pat. No. 6,172,275 assigned to Kabushiki Kaisha Toshiba discloses a method and apparatus for pyrolytical decomposition of waste plastic that includes halogen-containing polymers. The process discloses the use of a liquid heat transfer medium that is mixed with the waste plastics to improve the heat conductivity and thus reduces coke formation by the decomposition reaction. Liquid heat transfer media suffer from increasing the heat conductivity by only small increments that may not reduce significantly the coke formation. Another drawback for using a liquid heat transfer medium is the consumption during the high pyrolysis temperature which requires substitution of liquid heat transfer medium over time with make-up material.

The efficiency of the waste plastic pyrolysis process depends greatly on the residence time of the waste plastic and the fast removal of the hydrocarbon vapor. The international published patent application WO2012/172527 discloses a continuous thereto-catalytic process for decomposing waste plastic in a rotary pyrolysis reaction along with a continuous removal of pyrolysis byproducts from the pyrolysis reactor. The waste plastic feedstock is fed via a screw conveyor into the rotary pyrolysis reactor containing a partition structure located in the center of the pyrolysis reactor. The pyrolysis vapors are removed at the output end of the reactor. As a result, the hydrocarbon vapors formed are subjected to the high pyrolysis temperature along the entire length of the reactor leading to an increase in residence time of the hydrocarbon vapors. Furthermore, the hydrocarbon vapors are subjected to extended exposure of high temperature which in turn produces more non-condensable hydrocarbon gas and thus lowers the value of hydrocarbon fuel.

Pyrolysis processes for waste plastic materials disclosed in the prior art, e.g. U.S. Pat. No. 6,774,271 feed the shredded waste plastics at ambient into the pyrolysis reactor. The time until the waste plastic reaches the decomposition temperature requires more energy, increases the residence time and renders the process less efficient reducing the yield for the desired hydrocarbon oil including the middle distillate and light-range hydrocarbons.

In view of the foregoing, it is apparent that a need exists for a process and apparatus which is capable of safely, economically and continuously producing high quality hydrocarbon oil from a wide variety of waste plastic feedstock.

SUMMARY OF THE INVENTION

Accordingly, the present invention provides a process for producing continuously high quality hydrocarbon oil from waste plastics by thermally decomposing residential waste and industrial waste plastics.

The present invention further provides an apparatus for a thermal decomposition of waste plastics to produce high quality hydrocarbon oil from residential and industrial waste plastics.

In particular, the present invention provides a process for producing high quality hydrocarbon oil from residential and industrial waste plastics which are decomposed in a continuous pyrolysis process with a continuous feeding and discharging to convert post-consumer waste and post-industrial plastics into quality hydrocarbon fuel. The post-consumer and post-industrial waste comprises polypropylene (PP), polyethylene (PE), polystyrene (PS) and residual, polyvinyl chloride (PVC) and polyethylene terephthalate (PET) and up to 10% by weight water. The process is also applicable to convert waste rubber and related materials into hydrocarbon products.

According to the invention, the pyrolysis process comprises the steps of: drying waste plastic at about 150° C. to 180° C. for about one hour to less than about one percent moisture at discharge, melting the dried waste plastic in a first screw reactor at about 290° C. to 325° C., feeding the liquid mixed waste plastic via a pump screw into a second screw pyrolysis reactor, thermally decomposing the liquid plastic material by heating the liquid waste plastic to about 450° C. to 500° C. to produce a hydrocarbon vapor, condensing the hydrocarbon vapor in a plurality of condensers, whereby the hydrocarbon fuel is fractioned into different grades of hydrocarbon oil comprising long-chain hydrocarbons, middle distillate hydrocarbons, and light-grade hydrocarbons; and collecting the condensed hydrocarbon fuel.

The present invention further comprises the steps of: treating and removing the chloride components which are formed in the first screw reactor by decomposition of any chloride-containing plastic material, in a scrubber operated with water and alkali hydroxide, treating any volatile organic components (VOCs) which are formed by decomposition of any benzene-containing waste plastic from the first screw reactor to a thermal oxidizer whereby the VOC is removed through thermal combustion, while at the same time recovering the heat value and recirculating the heat into the jackets of the pyrolysis reactor.

The present invention further comprises the steps of: catalytically treating the hydrocarbon vapors generated in the pyrolysis reactor in a chamber comprising a plurality of transition metal inserts to further decompose any long-chain hydrocarbons, treating the hydrocarbon vapors with a dry neutralizing salt to remove halogen and sulfur components, removing ash and solids from the pyrolysis vapor, feeding back the condensed long-chain hydrocarbons from the first condenser to the pyrolysis reactor to facilitate heat transfer, decomposing the long-chain hydrocarbons further, and storing the hydrocarbons from the second condenser containing the middle distillate and from the third condenser containing light-range hydrocarbons in storage tanks.

Non-condensable gases from the pyrolysis reactor are pressurized with a blower and fed into a thermal oxidizer together with scrubbed off-gases from the melt reactor to fully decompose the non-condensable materials and to recover the heat value for heating the pyrolysis reactor. The pyrolysis process is carried out under a slight vacuum, preferably at about 14.5 psia or less.

According to the present invention, the pyrolysis reactor comprises a longitudinal vaporization kiln, a screw installed in the longitudinal pyrolysis reactor and wherein the screw is helically connected to a heated screw shaft, a feeding end connected to a positive displacement screw for charging the reactor with liquid waste plastic feed, a plurality of ports mounted on top of the pyrolysis reactor for fast removal of the hydrocarbon vapors, a discharge/separation unit connected with the second end of the reactor, and a screw system connected to the discharge/separation unit and the first end of the reactor for continuously recycling a metallic heat transfer medium and wherein the metallic heat transfer medium comprises metallic ball bearings. The representative dimension of the screw pyrolysis reactor may vary, but the preferred length is about 25-30 feet and the preferred diameter is about 2.5-3.0 feet. The feed rate for the waste plastic through the pyrolysis reactor may vary, but the preferred rate is about 20 to 35 metric tons per 24 hours. The rotating screw of the pyrolysis reactor transfers the plastic material along the entire length of the reactor whereby the plastic material is decomposed. The ball bearings are charged with a constant loading speed and move together with the plastic material through the entire length of the pyrolysis reactor significantly reducing the coke build-up on the reactor walls and thus increasing the heat transfer of the pyrolysis reaction. In addition, the ball bearings comprise transitional metal to further facilitate the waste plastic degradation by catalytic means. The second end of the reactor is connected with a separation chamber for continuously collecting the discharged balls and pyrolysis ash, and the ball returning screw unit. The ash passes into a cooling screw via an air lock. The separation chamber at the second end of the pyrolysis reactor is connected with the ball bearing returning screw transferring the ball bearings back to the first end of the reactor.

Another embodiment of the present invention contains a gas purifier unit comprising a dry spray injection section which includes a cyclone filtration and a ceramic filtration section for cleaning the hydrocarbon vapors, and an airlock for discharging solids. The hydrocarbon gases enter the dry spray injector where any hydrogen chloride gases present react with a neutralizing alkali salt. The filter section of the gas purifier collects the ash and alkali salts via cyclone action and filter elements. The filter solids are collected in the bottom of the unit and pass through a vapor lock into a cooling screw. The gas purifier removes any acid gas and sulfur components with a greater than 99% removal rate prior to discharge. The filtered hydrocarbon gases exit the unit flowing to the condenser.

The system according to the present invention further comprises a pretreatment process of the received mixed waste plastic to separate out ferrous, and non-ferrous metals and other non-desirable materials including but not limited to PVC and PET, wood, paper, and other waste materials from the waste plastic feed and to shred the feed materials into pieces of about one to two inches.

The present invention provides a process for thermally decomposing residential and industrial waste plastics comprising the steps of: drying the waste plastic to remove moisture contained in the waste plastic to less than about one percent, melting the waste plastic in a melt reactor in which the melting proceeds at a temperature of about 290-325° C., and preferably at about 320° C., feeding the waste plastic into a pyrolysis reactor to perform a thermal decomposition; decomposing the waste plastic at a temperature of about 450-500° C. and forming hydrocarbon vapors; condensing and fractionating the hydrocarbon vapors from the decomposition in a plurality of condensers; and collecting the fractioned hydrocarbon fuel. Said process further comprises a step of circulating a metallic heat transfer medium through the pyrolysis reactor to reduce coke formed during the thermal decomposition wherein the metallic heat transfer medium contains a transition metal selected from a group consisting of Nickel, Vanadium, Titanium, Cobalt, Molybdenum and a mixture thereof. Said process further comprises a step of neutralizing acidic gas contained in the hydrocarbon vapors with a dry neutralization powder selected of a group consisting of sodium bicarbonate, sodium carbonate, sodium hydroxide, calcium hydroxide, and calcium oxide wherein the neutralization powder is applied with a spray nozzle. Said thermal decomposition is carried out in a vacuum, preferably in a vacuum of about 13.8 to 14.6 psia wherein the vacuum is produced by a draft blower.

The invention further provides an apparatus for producing hydrocarbon oil from residential and industrial waste plastic comprising a pumping screw, a pyrolysis reactor wherein said pyrolysis reactor may be constructed on a or on an inclined plane, wherein the inclined plane is within 0 degree to 15 degree off the plane. The reactor further comprises a discharging screw unit connected to the end of the reactor. The pumping screw comprises a first cylindrical housing; a screw conveyor axially connected to a shaft; a motor fixed to the shaft of the screw conveyor; a feeder connected with a feeding end of the pyrolysis reactor, and an airlock connecting the feeder and the cylindrical housing. Said pyrolysis reactor comprises a second cylindrical housing, a heating mantle surrounding the cylindrical housing for indirect heating, a screw conveyor wherein the screw is helically connected to a shaft; a motor fixed to the shaft of the screw conveyor rotating along the axis of the cylindrical housing, and a feeding end for charging the reactor with melted liquid waste plastic feed. The rotating screw of the pyrolysis reactor transfers the waste plastic along the entire length of the pyrolysis reactor whereby the plastic material is decomposed.

The pyrolysis reactor further comprises a plurality of ports mounted on top of the pyrolysis reactor to quickly remove the decomposition vapors, a discharge unit at the second end of the reactor which is connected to a separation chamber and a second screw conveyor system connecting to the feeding end and to the discharging end of the pyrolysis reactor for continuously recycling a metallic heat transfer medium, and wherein the metallic heat transfer medium comprises metal ball bearings. The ball bearings are fed into the pyrolysis reactor with a constant loading speed. The ball bearings together with the plastic material are carried by the screw through the entire length of the pyrolysis reactor reducing or eliminating coke from building on the walls of the reactor and thus increasing the heat transfer of the pyrolysis reaction.

Another embodiment of the pyrolysis reactor comprises a separation chamber connected to the discharging end of the reactor for separating discharged ball bearings from any pyrolysis ash, and a cooling screw. The ash discharging end and the cooling screw are connected to an airlock to safely remove any ash. The discharging end of the pyrolysis reactor is connected to the ball bearing screw which continuously recycles the ball bearings to the first end of the reactor.

The invention further provides a system for producing continuously hydrocarbon oil from residential and industrial waste plastic comprising: a dryer unit to dry the mixed waste plastic to less than 1% moisture and to preheat the plastic, a melt screw reactor to melt the waste plastic at about 290-325° C. while any PVC decomposes and removing the formed HCl gas prior to the pyrolysis, a pumping screw to pump the liquid plastic into the pyrolysis unit, a pyrolysis reactor to thermally decompose the waste plastic at about 400-600° C. into hydrocarbons whereby the hydrocarbon gas exits the pyrolysis reactor through a plurality of vapor vents located at the top section of the pyrolysis reactor, a catalytic treatment unit comprising a transition metal insert through which the hydrocarbon gas passes to further decompose long chain hydrocarbons, a gas purifying unit, wherein the hydrocarbon gas is chemically treated to remove any acid and sulfur components, comprising a dry spray alkali injection treatment unit and a ceramic filter system, a condensing unit comprising a plurality of condensers operated at various temperatures to fractionate the hydrocarbon gas, into heavy oil, middle distillate and light-range, a thermal oxidizer to destroy any VOCs from the non-condensable hydrocarbons and the scrubber units, a first cooling screw connected to the discharging end of the pyrolysis reactor to safely remove any ash, and a second cooling screw connected to the discharging end of the gas purifier unit to remove inorganic solids. The system further comprises a ball bearing screw auger connected to the discharging and feeding end of the pyrolysis reactor to continuously recycle ball bearings together with the liquid plastic through the pyrolysis reactor to prevent coke build-up and aides in heat transfer.

According to the present invention, the process for producing hydrocarbon oil from thermal decomposition of waste plastic provides an improved process producing high quality hydrocarbon oil with increased yields compared to the prior art. Moreover, the process provides an economical, robust and flexible process to allow easy adjustment of process parameters based on waste plastic properties and composition. Furthermore, the pyrolysis process and apparatus provide an off-gas treatment with a greater than 99% removal rate of any chlorine and sulfur components and a more efficient utilization of recycled heat energy.

DETAILED DESCRIPTION OF THE INVENTION

Figure 1:
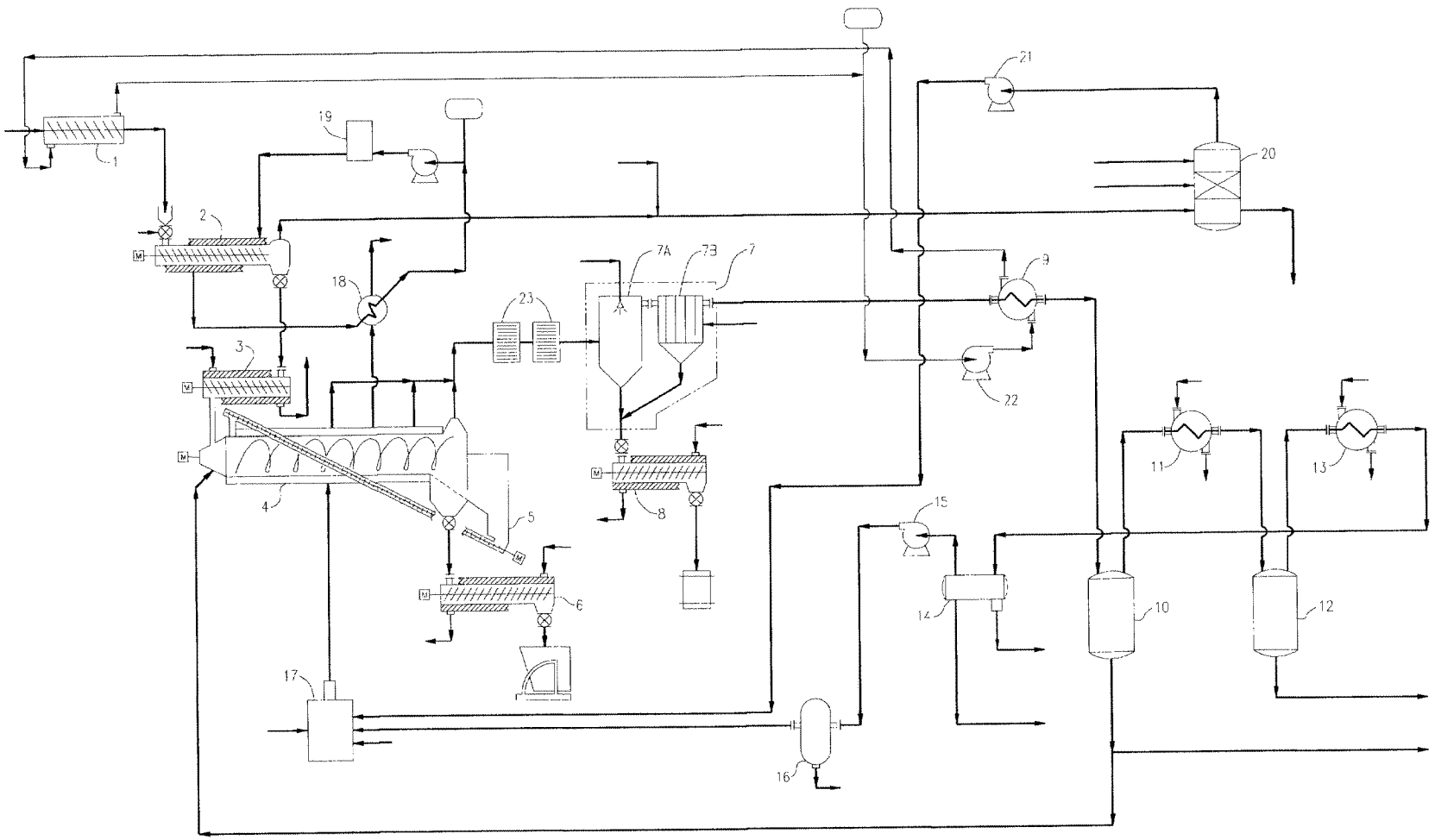
FIG. 1 shows a flow diagram of the preferred embodiments of a waste plastic thermal decomposition process according to the present invention comprising a melt screw reactor, a auger assisted rotary pyrolysis reactor and three condenser units for fractionation the different HC streams.

For purposes of simplification and the reader's convenience, the terms "pyrolysis", "decomposition", "thermal decomposition" or "thermal cracking" are used herein interchangeably for the thermochemical decomposition of waste plastic at elevated temperatures in absence of oxygen into petroleum hydrocarbons. The term "hydrocarbon" is used for describing the products obtained from the thermal cracking reaction and comprises hydrocarbon chains of different length and structure which can be separated into light-range, middle distillate, and heavy oil. The term "light-range" is used herein as hydrocarbons containing a carbon chain length of C5-C14, the term "middle distillate" is used herein as hydrocarbons containing a carbon chain length of C9-C22, and the term "heavy oil" is used herein as hydrocarbons containing a carbon chain length of C19-C30. The terms "ash", "coke" of "char" will be used herein interchangeably for the term "carbonaceous pyrolysis by-product or by-products". The term "screw reactor" is used herein for an apparatus containing a screw conveyor or auger conveyor that uses a rotating helical screw blade or flighting within a tube or trough to move liquid or solid materials.

The present invention provides a process for producing high quality hydrocarbon oil from the fast thermal decomposition of residential and industrial waste plastics in a continuous process comprising melting and feeding of a waste plastic feedstock and removing hydrocarbon gas and by-products containing coke or ash in a continuous manner. The process is also applicable to convert rubber and related materials into hydrocarbon products. Prior to the pyrolysis process the post-consumer and post-industrial waste plastic feedstock is conditioned by means for separating and shredding to remove metals, undesirable plastics including but not limited to non-thermoplastic materials using processes well known in the art. The pre-conditioned waste plastic undergoes a pre-treatment process comprising the steps of preheating and drying the waste plastic, melting the waste plastic and pumping the liquefied waste plastic into the pyrolysis reactor.

The pre-conditioned waste plastic feedstock comprises mainly polypropylene (PP), polyethylene (PE) to up to 98%, residual polystyrene (PS), polyvinyl; chloride (PVC) and polyethylene terephthalate (PET) in an amount of less than 2% and water in an amount of about 10% to 12% by weight. The total amount of residual PS, PVC and PET in the waste plastic feedstock after the conditioning step is less than 2% by wt of waste plastic, preferably less than 1% and most preferably 0.7%.

The thermal decomposition is carried out in a or inclined screw auger reactor, wherein the plane of the reactor can be or has an inclined plane which is tilted at an angle of 0 degree to 15 degree comprising a longitudinal housing, a heated screw including a screw shaft axially mounted in the center of the housing, a heating jacket, a motor for rotating the screw, a feeding end, vapor ports mounted on the top portion of the reactor, a discharging end, and a ball bearing screw feeder connecting the feeding end with the discharging end of the reactor on an inclined plane. The decomposition is performed at a temperature of about 400-600° C., and preferably at 430-550° C., and most preferably at 450-500° C. whereby the waste plastic decomposes into hydrocarbon gas. The hydrocarbon gas is condensed and separated in a plurality of condensers and collected.

A preferred embodiment of the process of the present invention comprises a pre-treatment step of the waste plastic comprising feeding waste plastics into a melt screw reactor, melting and liquefying the plastics at a temperature of about 290-325° C., decomposing chlorine-containing plastic including PVC, and scrubbing chloride gas from the degraded PVC in a scrubber. The next process step includes charging the liquid and partially degraded waste plastic into a screw pump, feeding the hot liquid waste plastic at about 325° C. into a pyrolysis reactor, and decomposing the liquid plastic at a temperature of about 450-550° C. A further process step includes removing the formed decomposition gas comprising hydrocarbons in a range of heavy, middle and light-range and condensing the decomposition gas into hydrocarbon oil. Feeding the melted waste plastic into the decomposition temperature of about 450-550° C. of the pyrolysis reactor reduces the residence time of the waste plastic and the formed hydrocarbon gases. The thermal decomposition is performed at a negative pressure of about 14.6 to about 13.8 psia, preferably at 14.5 psia. Performing the operation with a negative pressure improves the removal of the hydrocarbon gases from the pyrolysis reactor via vapor ports located on the top portion of the pyrolysis reactor. Another advantage of feeding a melted waste plastic into the pyrolysis reactor is a reduced residence time for the decomposition products rendering the process highly efficient and producing high quality hydrocarbon oil exhibiting high cetane numbers.

Another embodiment of the present invention comprises passing the hot pyrolysis gases through a plurality of transition metal catalyst trays, further decomposing the hydrocarbon gas into desirable middle distillate and light-range hydrocarbons, and removing acidic components contained in the hydrocarbon gas including hydrogen chloride and sulfur compounds by applying a dry spray injection of alkali salt, preferably sodium bicarbonate. Yet another embodiment of the present invention comprises a separation step separating the hydrocarbon gases in a plurality of condensers operating with different cooling media and temperatures to separate the hydrocarbon gases into the desired fraction of hydrocarbons with different carbon chain lengths and collecting the fractionated and condensed hydrocarbon liquids in storage containers.

A further embodiment of the present invention is an apparatus comprising a cylindrical heating vessel, a rotating device on one end comprised of a rotating screw helically fixed on a screw shaft extending in the longitudinal direction of the heating vessel which is connected with inlet tubes to heat the screw shaft and the rotating screw. The cylindrical pyrolysis reactor further comprises a feed pipeline on one end which is connected with a pump screw transferring the liquefied waste plastic into the pyrolysis reactor, a plurality of vapor ports fixed on top of the screw to remove the hydrocarbon vapors, a discharging end including a separation chamber to separate ash from other materials, a cooling screw connected with an airlock cooling the ash in order to stop any thermal reaction in the ash and to reduce the ash temperature to a range where the material can be handled safely.

The vapor ports mounted on top of the pyrolysis reactor ensure a quick removal of the generated hydrocarbon gas from the pyrolysis and a significant reduction of any further decomposition of the desired hydrocarbon gas into ash and non-condensable gases.

It is well known in the art of thermal decompositions that ash or coke build-up on the wall of the pyrolysis reactor reduces the heat transfer efficiency. It is important to reduce or eliminate the ash or coke formation during the thermal decomposition in order to increase the heat transfer efficiency and thus obtain high quality hydrocarbon oil from waste plastics.

A further embodiment of the present invention includes the use of a heat transfer medium that provides superior heat conductivity, but is chemically inert, can be easily recycled and provides easy separation from the pyrolysis gases and ash that may be formed during the pyrolysis. The preferred solid heat transfer medium comprises a plurality of metallic ball bearings that are recirculated through the pyrolysis reactor. The pyrolysis reactor includes a ball hearing system comprising a plurality of ball bearings and an inclined screw conveyor connected to the discharging end and the feed end of the pyrolysis reactor, which continuously recycles the ball bearings from the ash discharge area to the feed end of the pyrolysis reactor. The metallic ball bearings comprise a transition metal including but not limited to Nickel, Vanadium, Titanium, Cobalt, Molybdenum or a mixture thereof and have a diameter of about 0.5 to about 2 inches, and preferably of about 0.75 to about 1.5 inches. The ball bearings absorb thermal energy from the heated gas and thus increasing the heat transfer of the melted waste plastic and are moved through the pyrolysis reactor together with the liquid waste plastic by the rotating screw. The heated transition ball bearings further contribute as a catalyst to the pyrolysis of the waste plastic and catalyzing the cracking of the waste plastic. The continuous movement of heated metallic ball bearings in the pyrolysis reactor reduces the coke build-up on the reactor walls during the pyrolysis and improves the heat conductivity rendering the present invention more efficient with regard to the yield and quality of the hydrocarbon fuel.

Yet another embodiment of the present invention includes a catalytic chamber comprising a plurality of metal trays where the hot hydrocarbon gas from the pyrolysis reactor undergoes catalytic treatment. The metal tray contain a transition metal or a mixture of transition metals including but not limited to Nickel, Vanadium, Titanium, Cobalt or a mixtures thereof. The hot pyrolysis gas flows through a stack of transition metal trays further decomposing any long hydrocarbon chains that may be included in the pyrolysis gas. The hydrocarbon gases from the metal tray chamber enter a process gas reactor comprising a spray injection unit utilizing a dry alkali salt to neutralize the reaction gas and removing hydrogen chloride gas and any sulfur compounds that may be present in the hydrocarbon gas, and a subsequent filtration in a candle filter unit comprising a plurality of candle filters.

By-products formed during the pyrolysis include ash or coke which is discharged from the pyrolysis reactor into the cooling screw using cooling water supplied to the jacket of the cooling screw. The cooling of the ash from the pyrolysis reactor ensures safe handling of the ash on discharge. The discharged ash is collected in a dump hopper.

The pyrolysis gas obtained from the process gas reactor is mainly composed of short chain hydrocarbon, but it still contains long chain hydrocarbons which are undesirable. In a fractionating step, the pyrolysis gas is cooled and condensed in a plurality of condenser units. Accordingly, the plurality of condenser units provides for separating hydrocarbon oils having desired and high value shorter chain length by adjusting the temperature in each of the condenser units. In a further embodiment, the use of a plurality of condenser units provides the thermal decomposition process with a greater flexibility including but not limited to the feed makeup by adjusting the recycle temperature and using selective condensing temperatures. In the present invention, preferably three condensing units are used to achieve the fractionating step that renders the process most cost efficient and yields high quality hydrocarbon oil fractions.

The pyrolysis gas exits the pyrolysis reactor at a temperature of about 450-500° C. and enters the first condenser utilizing heat transfer oil as a cooling fluid. The temperature of the heat transfer oil is about 135° C. and cools the pyrolysis gas to a temperature of about less than 300° C. In the first condensing step low value long chain hydrocarbons which have not been completely decomposed in the pyrolysis reactor are separated from the gaseous short chain components. The condensed material which includes low value long-chain hydrocarbon oils is fed back to the pyrolysis reactor to subject those heavier hydrocarbon oils to a further thermal decomposition. Furthermore, the recirculated long-chain hydrocarbon oil also serves as a heat transfer fluid as it is recycled to the pyrolysis reactor at about 280° C. The heat generated in the first condenser is fed back to heat the plastic dryer unit where the waste plastic is dried prior the feeding it into the melt screw reactor. The remaining uncondensed pyrolysis gas from the first condenser is fed to a second condenser unit. Here, the pyrolysis gas is cooled to about less than 150° C. utilizing cooling water. The cooling temperature can be adjusted to about 120° C.-145° C. to condense a desired specific middle distillate hydrocarbon oil fraction. The middle distillate hydrocarbons are collected in a storage tank.

The remaining uncondensed pyrolysis gas from the second condenser is fed to a third condenser unit. The pyrolysis gas is cooled to about less than 55° C. utilizing cooling water. The cooling temperature can be adjusted to about between 40° C. and 55° C. to condense a specific light hydrocarbon fraction. The light-range hydrocarbons are collected in a storage tank. Any water containing in the light hyrdocarbon can be separated in the receiver. Non-condensable gas from the third condenser unit is pressurized using a blower and dried in the gas dryer. The dried gases from the dryer unit are fed back to a thermal oxidizer where any volatile organic components that may be contained in the dried pyrolysis gas are destroyed and mixed with natural gas to generate the heat needed for the indirectly heated melt reactor and for the pyrolysis reactor.

The process for producing hydrocarbon oil from the thermal decomposition of waste plastic is further shown in the drawing FIG. 1.

It should be noted that the present description is by way of instructional examples, and the concepts presented herein are not limited to use or application with any single pyrolysis method and/or apparatus. Hence, while the details of the innovation described herein are for the convenience of illustration and explanation with respect to exemplary embodiments, the principles disclosed may be applied to other types and applications of waste plastic methods and apparatus without departing from the scope hereof.

According to the invention, the system for generating hydrocarbon oil from the thermal decomposition of mixed waste plastic as shown in FIG. 1 comprises a dryer 1 where the shredded mixed waste plastic from a pre-treatment unit is dried at a temperature of about 150-170° C. to a moisture content of less than 1% by wt. The dried plastic material is continuously fed into the melt screw reactor 2 comprising a screw that is axially mounted in the center of the longitudinal melt reactor. The melt screw is heated on the shell and shaft with hot oil from the hot oil heater 19 which recovers heat from the stack gases utilizing a heat recovery from heat exchanger 18. The screw of the melt reactor 2 heats and melts the waste plastic at a temperature of about 290° C. to 325° C., preferably at 300° C. The melted waste plastic travels through the trough whereby polyvinyl chloride (PVC) that may be present in the mixed waste plastic undergoes thermal degradation generating hydrogen chloride gas (HCl). The PVC content in the waste plastic may be present in an amount of up to 0.50%. The hydrogen chloride gas travels to the scrubber column 20 by means of an induced draft blower 21 creating a negative pressure in the system of about 14.5 psia. The HCl gas is neutralized in subsequent treatment with water and sodium hydroxide. The melted plastic exits the melt screw reactor 2 into a pumping screw vessel 3 through an air lock. The pumping screw 3 comprises a screw having a tight tolerance to maintain a positive discharge head pressure, a variable speed controller to control the process rate and a heating jacket utilizing hot oil from the heater system 19 from the melt screw reactor 2 flowing through the jacket. The pumping screw reactor 3 transports the melted plastic to the charging end of the screw pyrolysis reactor 4 to undergo thermal decomposition at about 450° C. to 500° C. The rotating screw transfers the plastic material along the entire length of the pyrolysis reactor 4 while the plastic undergoes pyrolysis. As the pyrolysis occurs, hydrocarbon vapor and ash are formed and are continuously removed by the screw means in the pyrolysis reactor 4 through vapor vents. The ash/coke is discharged at the end of the screw of the reactor 4 through a screen into an airlock before being fed into a cooling screw conveyor 6 where the ash/coke is cooled to less than 100° C. and removed to a dump hopper.

The ball bearings used to reduce the ash build-up in the reactor and to increase the heat transfer are discharged from the pyrolysis reactor 4 together with the ash into a separation chamber comprising a screen. The size of the steel balls is from 0.5 to 2 inches, preferably between 0.75 to 1.25 inches. The ball bearings roll down the screen into a feed hopper which delivers the steel balls to the inclined screw conveyor which continuously recycles steel ball bearings back to the steel ball charging end of the pyrolysis reactor 4.

The negative pressure which is generated by blower 21 creates a vacuum of about 14.5 psia and aids the flow of the hydrocarbon gases out of the pyrolysis reactor 4. The hot hydrocarbon gases exit the pyrolysis reactor 4 through a plurality of exit ports located on top of the pyrolysis reactor and pass through a plurality of catalyst trays 23 comprising a transition metal or a mixture of transition metals including but not limited to Nickel, Vanadium, Titanium, Cobalt or a mixture thereof. The contact of the hot pyrolysis gas with a transition metal further catalyzes the decomposition of the long hydrocarbon chains that may be included in the pyrolysis gas which increases the yield of the middle distillate hydrocarbons. From the catalyst trays 23 the hydrocarbon gas flows to the process gas reactor 7 for treatment. In the gas reactor 7 any heavy components including HCl-gas and sulfur-containing compounds contained in the vaporized hydrocarbon gas are separated in the dry spray separator 7*a* by treating the hydrocarbon gas with a solid inorganic alkali salt including but not limited to solid sodium bicarbonate, sodium carbonate, sodium hydroxide, lime or a mixture of sodium bicarbonate and lime to remove all the remaining HCl and sulfur components. The preferred inorganic alkali salt for the dry spray neutralization of HCl gas is sodium bicarbonate. The dry spray separator 7*a* comprises an injection nozzle through which the dry neutralization medium is injected to react with the pyrolysis gas. As a result, the heavy components in the pyrolysis gas react with the sodium bicarbonate to form inorganic solids which are separated from the pyrolysis gas in a separator unit 7 containing a candle filter unit 7*b* comprising a plurality of candle filters. The solids are collected in a cluster of filter candles 7*b* in separator unit 7 and continuously discharged by applying pulses of nitrogen purges to the filter candles releasing the inorganic solids which are fed into the cooling screw unit 8. The discharge of the solids is triggered by a pre-determined pressure drop. The pyrolysis gas passes through the candle filter cluster unit 7*b* into a condenser unit comprising a plurality of condensers.

The inorganic solids from the filter candle cluster 7*b* are cooled in a cooling screw vessel 8 using cooling water supplied into the jacket of the cooling screw 8. The cooling of the inorganic solids ensures the safe handling of the ash on discharge. The discharged inorganic solids are collected in a solid receiver.

The by-products formed during the pyrolysis include ash which are discharged from the pyrolysis reactor into the cooling screw 6 using cooling water supplied to the jacket of the cooling screw 8. The cooling of the ashes from the pyrolysis reactor prevents potential ignition on discharge. The discharged ashes are collected in a dump hopper.

The pyrolysis gas obtained from the process gas reactor 7 is mainly composed of light and middle distillate hydrocarbons, but it still contains some low value heavy oil hydrocarbons which are undesirable. In a fractionating step, the pyrolysis gas is cooled and condensed in a plurality of condenser units. Accordingly, the plurality of condenser units provides for separating hydrocarbon oils having desired high value chain length by adjusting the temperature in each of the condenser units. In a further embodiment, the use of a plurality of condenser units provides the thermal decomposition process with a greater flexibility including but not limited to the feed makeup by adjusting the recycle temperature and using selective condensing temperatures. In the present invention, preferably, three condensing units are used to achieve the fractionating step that is most process and cost efficient and yielding high value hydrocarbon products.

In the first condenser 9 the pyrolysis gas is cooled to a temperature of about less than 300° C. separating undesirable heavy oil hydrocarbons which have not been completely decomposed in the pyrolysis reactor from the desired short chain hydrocarbons. The condensed material containing the heavy hydrocarbon oils are fed back to the pyrolysis reactor to subject those heavier hydrocarbon oils to the thermal decomposition and generating an increased residence time for the heavier hydrocarbon oils. The heat generated in the first condenser is fed back to the dryer unit 1 for drying the waste plastic material.

The remaining uncondensed pyrolysis gas from the first condenser 9 is led to a second condenser unit 11. Here, the pyrolysis gas is cooled to about less than 150° C. The cooling temperature can be adjusted to about between 120° C. and 150° C. to condense the middle distillate hydrocarbon oil which is collected in receiver 12.

The remaining uncondensed pyrolysis gas from the second condenser 11 flows to a third condenser unit 13. Here, the pyrolysis gas is cooled to about less than 55° C. The cooling temperature can be adjusted to about between 40° C. and 55° C. to condense the desired and high value light hydrocarbon fraction. The light hydrocarbons are collected in receiver 14. Any water containing in the light hydrocarbon can be separated in the receiver 14. Non-condensable gas from the receiver 14 is pressurized using a blower 15 and dried in the gas dryer 16. The dried gases from the dryer unit 16 are fed back to a thermal oxidizer 17 where any volatile organic components that may be contained in the dried pyrolysis gas are destroyed and mixed with natural gas to generate the heat needed for the indirectly heated melt reactor 1 and for the pyrolysis vessel 4.

Another embodiment of the present invention includes an apparatus for producing hydrocarbon oil from thermal decomposition of waste plastics. The apparatus is shown in FIG. 2, and comprises: a first pump screw reactor 3, a screw pyrolysis reactor 4, a ball bearing chamber 5 connected to a conveyor screw on one end of the ball bearing chamber 5 to recirculate a heat transfer medium through the pyrolysis reactor 4.

The pyrolysis reactor 4 comprises a cylindrical heating vessel 4 and a rotating device on one end comprising a rotating screw 24, wherein the rotating device is mounted axially on a screw shaft 25 extending in the longitudinal direction of the heating vessel and connected between the two ends of the reactor 4, and a motor connected with the rotating screw 24. The screw shaft 25 comprises a hot gas inlet 32 to the shaft and a hot gas outlet 33 from the shaft to heat the screw shaft 25 and the rotating screw blade 24 to a temperature of about 450-500° C., preferably at 500° C. The pyrolysis reactor 4 may be constructed on a or on an inclined plane, which is tilted at an angle of 0 degree to about 15 degree. The reactor 4 further comprises a feed pipeline on the charging end which is connected with the discharging end of the pump screw 3. The pyrolysis reactor 4 further comprises a plurality of vapor ports 26. wherein the vapor ports 26 connect the inside to the outside of the reactor 4 and are positioned on the top section of reactor 4 from about one fourth of the length to the end of the pyrolysis reactor 4. The preferred number of vapor ports is at least 3 ports over the entire length of the reactor 4. The vapor ports 26 are connected with a catalysis chamber 23 (FIG. 1) for further treatment.

Figure 2:
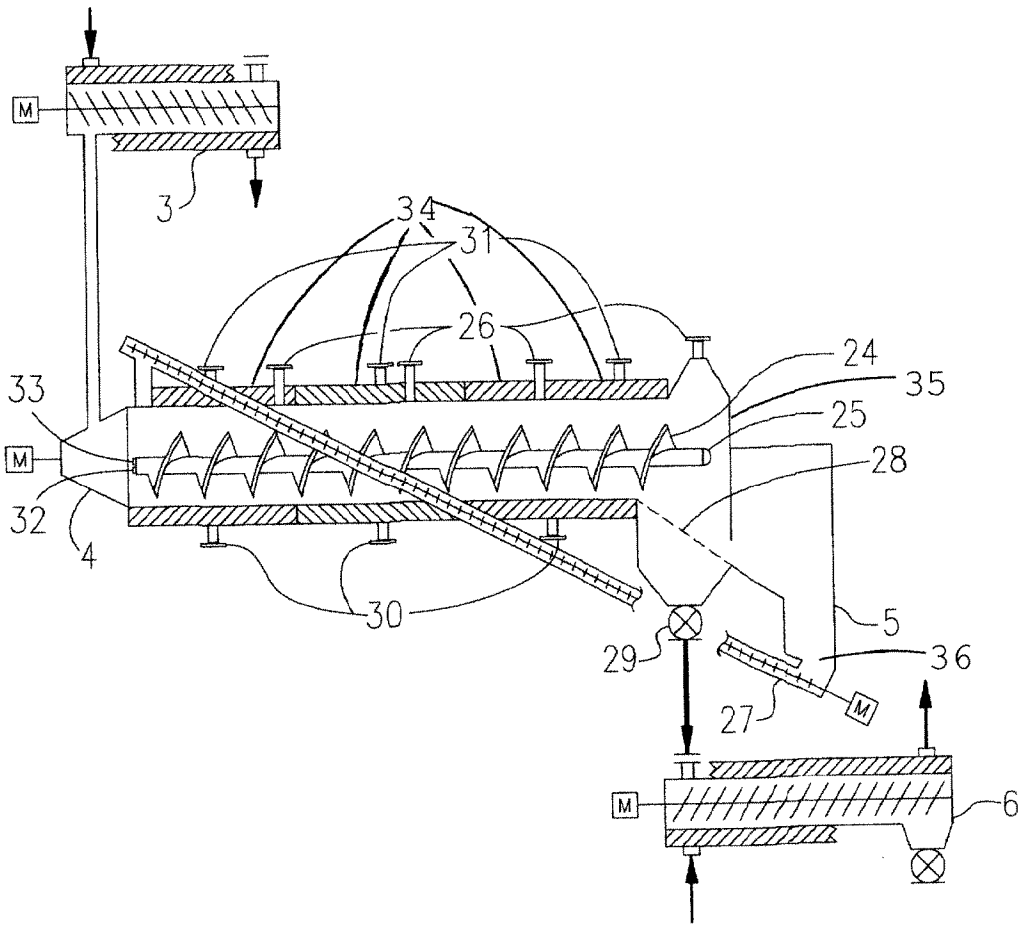
FIG. 2 is a view of the pumping screw and the pyrolysis screw reactor including the ball bearing recirculating unit for improving the heat transfer and the ash cooling screw.

A further embodiment of the pyrolysis reactor 4 as shown in FIG. 2 comprises a separation unit 5 including a discharging end and a conveyor screw, wherein the conveyor screw is connected with the discharging end of separation unit 5 and the top of the reactor's front end to recirculate a heat transfer medium between the discharging end of the separator unit 5 and the heat transfer charging end of reactor 4. The heat transfer medium enters the reactor 4 on the front end and moves through the reactor 4 with the melted waste plastic by the rotating screw blade 24 to increase the heat transfer by reducing or eliminating coke build-up on the walls.

The heat transfer medium comprises a plurality of solid metallic ball bearings. The screw conveyor 27 continuously recycles the ball bearings from the separation unit 5 via the separation screen 28 to the top feed end of the pyrolysis reactor 4. The ball bearings move through the reactor 4 with the melted plastic by the rotating screw blade 24 to increase the heat transfer by reducing or eliminating coke build-up on the walls. The ball bearing may contain stainless steel or preferably transition metal including but not limited to Nickel, Vanadium, Titanium, Cobalt and a mixture thereof to improve the pyrolysis process of the waste plastic by catalytic means and thus rendering the present invention more efficient with regard to the yield of hydrocarbon oil. The separation chamber 5 comprises a screen 28 where the ball bearings are separated from the ash that may have formed during the pyrolysis and discharged via an airlock 29 to the cooling screw conveyor 6. Here, the ash is cooled using cooling water to ensure safe handling.

The pyrolysis reactor 4 further comprises a plurality of heating jacket segments located at the front, middle and end section of the pyrolysis reactor 4 to heat the reactor 4 using stack gases from the thermal oxidizer 17 (FIG. 1). Each of the heating jacket segments contain a hot gas jacket inlet 30, and a hot gas jacket outlet 31 allowing the heating jacket to be heated independently to ensure that the temperature is maintained at about 480-500° C. over the entire length of the reactor. A person skilled in the art will appreciate that the plurality of heating jacket segments surrounding the reactor 4 eliminates the formation of any temperature gradient between the charging and discharging end of the reactor 4 rendering the pyrolysis reaction more efficient.

The present invention is designed and simulated with a capacity of 25 mt per day of feed according to the process shown in FIG. 1. The following examples are intended to illustrate certain embodiments of the present invention, but do not exemplify the full scope of the invention.

Example 1

A simulation of the process using a commercial plant design was performed based on the process shown in FIG. 1 and the pyrolysis reactor 4 as shown in FIG. 2. The thermal decomposition process and reactor 2 are designed to continuously process 25 tons per 24 hours of waste plastic or 2296 lb/hr mixed plastic feedstock. The composition of the plastic feedstock is 45 wt % LDPE, 49 wt % PP, 2 wt HDPE, and 0.25 wt % PS, 0.35 wt % PVC, 0.1% PET, and 3 wt % other plastics, as outlined in Table 1.

TABLE 1

Hydrocarbon Product and Recycled Streams produced in thermal decomposition calculated for a typical waste plastic feedstock

| Waste Plastic Feedstock | Feed Composition % | Feed Stream lb/hr |
|---|---|---|
| PP | 49 | 1132 |
| LDPE | 45 | 1033 |
| HDPE | 2 | 46 |

TABLE 1-continued

Hydrocarbon Product and Recycled Streams produced in thermal decomposition calculated for a typical waste plastic feedstock

| Waste Plastic Feedstock | Feed Composition % | Feed Stream lb/hr |
|---|---|---|
| PET | 0.1 | 2 |
| PVC | 0.35 | 8 |
| PS | 0.25 | 6 |
| other | 3 | 69 |

The pyrolysis reactor 4 is 25 feet long and has a diameter of 2.5 feet. The mixed waste plastic has a moisture content of about 10% by weight. The waste plastic is shredded into pieces of about 2 inches by 2 inches and fed into a dryer and heated to 160° C. for one hour and moved through the drying vessel by a rotating screw rotating at a speed of 5-10 RPM. The moisture content at discharge is less than 1% by weight. The dried waste plastic is fed at a feed rate of 2296 lb/hr into the melt screw reactor 2 which is 30 feet long and 2.5 feet in diameter. The melt screw reactor 2 is heated to 300° C. for one hour at a screw rotational speed of 5 RPM melting the waste plastic. The melt screw reactor 2 is heated with a hot oil unit 19 which produces the start-up heat or supplemental heat for the melting step. The heating mantle of the melt screw reactor is connected with a heat exchanger to recover heat. During the melting step the decomposition of PVC produces HCl gas in the amount of about 2% by weight of feed which is neutralized and removed in the scrubber 20 in a subsequent treatment with water and NaOH.

The waste plastic melt is pumped via the second pump screw 3 into the pyrolysis reactor 4. The thermal decomposition is carried out at a temperature of 500° C. for one hour under a vacuum of 14.5 psia maintains constant motion with the screw component 24 across the transfer surface. Metallic ball bearings having a 1 inch diameter are added to the feeding end of reactor 4 via the screw conveyor 5. The pyrolysis vapors exit the reactor 4 through four vapor ports 26 which are mounted on the top part of reactor 4 and enter the catalytic metal tray reactor 23 to undergo a second decomposition step. The hydrocarbon gas then enters the dry spray vessel 7*a* of gas purifier 7 to be sprayed with a dry sodium bicarbonate removing any remaining hydrogen chloride and sulfur by more than 99%. The hot ash formed in the dry spray vessel 7*a* is cooled in the cooling screw reactor 6 using water as a cooling fluid and the ash is collected. About 230 pounds of ash/coke is produced which is less than 10% per feed hour. The neutralized pyrolysis vapors enter the candle filter unit 7*b* to remove solids. Filter candles of unit 7*b* are automatically cleaned when a certain pack pressure is reached. The HCl removal is greater than 99%.

The treated pyrolysis gases enter the first condenser 9 operated with cooling oil to reduce the temperature of the vapors from 450° C. to 280° C. containing the first cut of hydrocarbons, which are recycled back into the pyrolysis reactor 4 to undergo a second pyrolysis step and simultaneously serve as a heat transfer fluid. About 22% of the first cut hydrocarbons are collected in receiver 10 and recycled back into the pyrolysis reactor 4. The uncondensed vapors containing the middle distillate-range and light-grade hydrocarbons are fed into the second condenser 11 and cooled from 280° C. to 145° C. 1400 pounds or 61% middle distillate-containing hydrocarbons are collected in receiver 12. Any uncondensed vapors from condenser 11 are fed into a third condenser 13 where the vapors are cooled from 145°

C. to 52° C. containing 390 pounds or 17% of the third cut stream containing the light-range hydrocarbons and are collected in receiver 14. Non-condensable vapors from condenser 14 amount to 277 pounds or 12% calculated based on the waste plastic feedstock stream of 2296 lb/hr. The non-condensable vapors are pressurized via blower 15 that produces a negative draft pressure of about 14.5 psia and are fed back to the thermal oxidizer 1.

TABLE 2

Recycled Stream and Hydrocarbon Product Cuts from the 3 condensers calculated for a typical waste plastic feedstock

| Total HC Products | Amount lb/hr | Percentage % | Temperature of HC cut from first, second and third condenser [° C.] | Average Molecular Weight of HC Stream [g/mol] |
|---|---|---|---|---|
| 1st cut - recycle stream (from receiver 10) | 500 | 22 | 280 | 294 |
| 2nd cut - middle distillate stream (from receiver 2) | 1400 | 61 | 143 | 192 |
| 3rd cut - light hydrocarbon stream (receiver 14) | 390 | 17 | 52 | 108 |
| Non-condensable Gas | 277 | 12 | 52 | 52 |
| Ash from Pyrolysis Reactor | 230 | | | |

More generally, those skilled in the art will readily appreciate that all parameters, dimensions, materials, vessel and reactor configuration described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, material, and/or process described herein. In addition, any combination of two or more such features, systems, materials, and/or methods, if such features, systems, materials, and/or methods are not mutually inconsistent, is included within the scope of the present invention.

What is claimed is:

1. A pyrolysis reactor for continuously producing a hydrocarbon oil from a melted waste plastic and separating a hydrocarbon vapor from a solid byproduct comprising:

a reactor body comprising:

a longitudinal side, a first end, a second end located on the opposite side of the reactor body from the first end;

a side having a cylindrical shape, connecting the first end and the second end;

an inside; and an outside;

a first inlet feed connected through the first end, wherein the first inlet feed is capable of transferring the melted waste plastic into the inside of the reactor body;

a first outlet chamber connected to the second end, the first outlet chamber further comprising:

an opening positioned along a longitudinal wall of the first outlet chamber, wherein the opening is located between about 60 percent and about 90 percent of the length of the longitudinal wall, and a grating positioned within the first outlet chamber and connected to the opening, and wherein the grating is oriented on an inclined angle of at least 25 degrees;

a first screw device located on the inside of the reactor body, wherein the first screw device is hollow and comprising a heating system;

a plurality of vapor ports positioned along the longitudinal side of the reactor;

wherein the vapor ports are capable of removing the hydrocarbon vapor from the inside to the outside of the reactor;

a second outlet chamber connected to the opening of the first outlet chamber and comprising a discharging end located on the bottom of the second outlet chamber; and a second screw device connecting the discharging end with the first end of the reactor body at an inclining angle of at least 20 degrees; and a solid heat transfer medium located inside the reactor body capable of transferring heat from the solid heat transfer medium to the melted waste plastic.

2. The pyrolysis reactor according to claim 1, further comprising a plurality of heating jackets at least partially surrounding the outside of the longitudinal side of the reactor body.

3. The pyrolysis reactor according to claim 1, wherein the first outlet chamber further comprising a first outlet port located on the bottom of the first outlet feed comprising an airlock.

4. The pyrolysis reactor according to claim 1, wherein the first screw device further comprising a first longitudinal hollow shaft having a fifth end and a sixth end opposite of the fifth end;

a hollow screw helically attached around at least a portion of the longitudinal hollow shaft;

a shaft inlet and a shaft outlet located on the fifth end extending into the hollow shaft;

wherein the longitudinal shaft is mounted rotatingly between the first end and the second end of the reactor body; and wherein the first screw device further comprising a heating system capable of heating the hollow screw and maintaining a substantially uniform temperature inside the reactor body.

5. The pyrolysis reactor according to claim 1, wherein the second conveyor further comprising: a second screw device having a second longitudinal shaft and a second helical screw around at least a portion of the longitudinal shaft; and a motor.

6. The pyrolysis reactor according to claim 1, wherein the second conveyor extends on an inclined angle of at least 20 degrees from the second outlet of the second outlet chamber to the first end of the reactor body; and wherein the second conveyor device is connected with a motor located on the first outlet port.

7. The pyrolysis reactor according to claim 1, wherein the first screw device continuously moves the solid heat transfer medium from the first end to the second end of the reactor body; and wherein the solid heat transfer medium exits the reactor body through the first outlet chamber over the grating located inside the first outlet chamber, and is collected in the second outlet chamber.

8. The pyrolysis reactor according to claim 1, wherein the second screw device is capable of continuously recycling the solid heat transfer medium from the second outlet chamber to the first end of the reactor body.

9. The pyrolysis reactor according to claim 1, the solid heat transfer medium comprises a spherical shape, wherein the spherical heat transfer medium has a diameter within the range of about 0.5 inches to about 2.5 inches.

10. The pyrolysis reactor according to claim 1, wherein the solid heat transfer medium comprises transition metals selected from a group consisting of nickel, vanadium, titanium, cobalt, molybdenum and mixtures thereof capable of catalyzing a thermal decomposition of the melted plastic.

11. A pyrolysis reactor system for continuously producing a hydrocarbon oil from a melted waste plastic and separating a gaseous hydrocarbon oil from a solid byproduct comprising:

a reactor body comprising:

a longitudinal side, a first end, a second end located on the opposite side of the reactor body from the first end;

a side having a cylindrical shape, connecting the first end and the second end;

an inside; and an outside;

a first inlet feed connected through the first end, wherein the first inlet feed is capable of transferring the melted waste plastic into the inside of the reactor body;

a first outlet chamber connected to the second end, the first outlet chamber further comprising:

an opening positioned along a longitudinal wall of the first outlet chamber, wherein the opening is located between about 60 percent and about 90 percent of the length of the longitudinal wall, and a grating positioned within the first outlet chamber and connected to the opening, and wherein the grating is oriented on an inclined angle of at least 25 degrees;

a first screw device located on the inside of the reactor body, wherein the first screw device is hollow and comprising a heating system;

a plurality of vapor ports positioned along the longitudinal side of the reactor;

wherein the vapor ports are capable of removing the hydrocarbon vapor from the inside to the outside of the reactor;

a second outlet chamber connected to the opening of the first outlet chamber and comprising a discharging end located on the bottom of the second outlet chamber;

a second screw device, wherein the second screw device is connected with the discharging end and the first end of the reactor body at an inclining angle of at least 20 degrees;

a solid heat transfer medium located inside of the reactor body capable of transferring heat from the heat transfer medium to the melted waste plastic;

a second screw reactor connected with the first inlet feed of the reactor body, comprising a substantially horizontal cylindrical body having a fifth end and a sixth end opposite the fifth end;

a third screw device; and a heating jackets at least partially surrounding the third screw reactor, capable of maintaining the waste plastic in a melted phase; wherein the third reactor is capable of transferring the melted waste plastic continuously into the first inlet feed of the reactor body.

12. A pyrolysis reactor system according to claim 11, further comprising:

a third screw reactor connected with the first outlet port of the first outlet feed, comprising a seventh end and an eighth end opposite of the seventh end; a fourth screw device; and a heating jackets at least partially surrounding the fourth screw reactor, wherein the third screw reactor is capable of removing the solid byproduct from the pyrolysis reactor.

* * * * *